United States Patent [19]

Bankstahl

[11] 4,201,391

[45] May 6, 1980

[54] FLEXIBLE BELLOWS END CONNECTION IN A MARINE STERN DRIVE

[75] Inventor: Herbert A. Bankstahl, Fond du Lac, Wis.

[73] Assignee: Brunswick Corporation, Skokie, Ill.

[21] Appl. No.: 875,446

[22] Filed: Feb. 6, 1978

[51] Int. Cl.[2] ..... F16J 3/04

[52] U.S. Cl. ..... 277/30; 277/212 FB; 115/35

[58] Field of Search ..... 115/35; 277/212 FB, 277/30, 207 A

[56] References Cited

U.S. PATENT DOCUMENTS

| | | | |
|---|---|---|---|
| 2,305,265 | 12/1942 | Tourneau | 277/212 FB |
| 3,136,285 | 6/1964 | Kiekhaefer | 115/35 |
| 3,219,354 | 11/1965 | Kazienko | 277/207 A |
| 3,645,546 | 2/1972 | Kaufmann | 277/30 |
| 3,666,276 | 5/1972 | Hubler | 277/30 |
| 3,888,203 | 6/1975 | Lohse | 115/35 |
| 3,953,037 | 4/1976 | Winfield | 277/30 |

*Primary Examiner*—Robert I. Smith

*Attorney, Agent, or Firm*—Andrus, Sceales, Starke & Sawall

[57] ABSTRACT

A flexible bellows assembly covers the universal drive coupling connecting between a marine stern drive unit and the inboard engine.

The flexible bellows includes a rectangular bead at the periphery of one end and is tubular shaped at the other end. The tubular shaped end is sealably clamped over a projecting portion of the transom bracket and the rectangular bead end is sealably contained within a clamping chamber formed by complimentary portions of the stern drive unit housing and the bell housing portion of the pivot mounting assembly.

3 Claims, 4 Drawing Figures

FLEXIBLE BELLOWS END CONNECTION IN A MARINE STERN DRIVE

BACKGROUND OF THE INVENTION

This invention relates to a flexible bellows enclosing the universal drive coupling between the stern drive unit and the inboard engine of a marine drive and particularly concerns the end connection of the flexible bellows with the drive unit.

Marine stern drive units generally include an outboard drive unit and an inboard engine. A universal drive coupling connects the engine and the drive unit to permit pivoting of the drive unit. A flexible bellows covers the coupling and is clamped at the inner end to a portion of the transom bracket and at the outer end to a projecting portion of the drive unit housing. Although this prior method of mounting the flexible bellows provides a highly satisfactory seal, it is difficult to install and remove the flexible bellows because of containment within the bell housing and the close placement of the exhaust connection.

SUMMARY OF THE INVENTION

A marine stern drive comprising (a) a transom mount having a drive coupling opening therethrough, (b) a bell housing having a drive coupling opening therethrough, (c) pivotal attachment means between the transom mount and the bell housing, (d) a drive unit housing having a projecting mounting member, (e) a drive coupling extending through the openings in the transom mount and the bell housing, (f) complimentary surfaces on the drive unit housing and the bell housing at the drive coupling opening defining an annular chamber therebetween, and (g) a flexible bellows extending over the drive coupling having a bead shaped end clamped within said annular chamber.

The inventor has found that clamping one end of the flexible bellows in a clamping chamber formed between the drive unit housing and the bell housing provides for ease in assembly and diassembly. This also permits the use of a solid exhaust coupling assembly which may substantially block removal of the conventional clamped flexible bellows.

DESCRIPTION OF THE PREFERRED EMBODIMENTS

Figure 1:
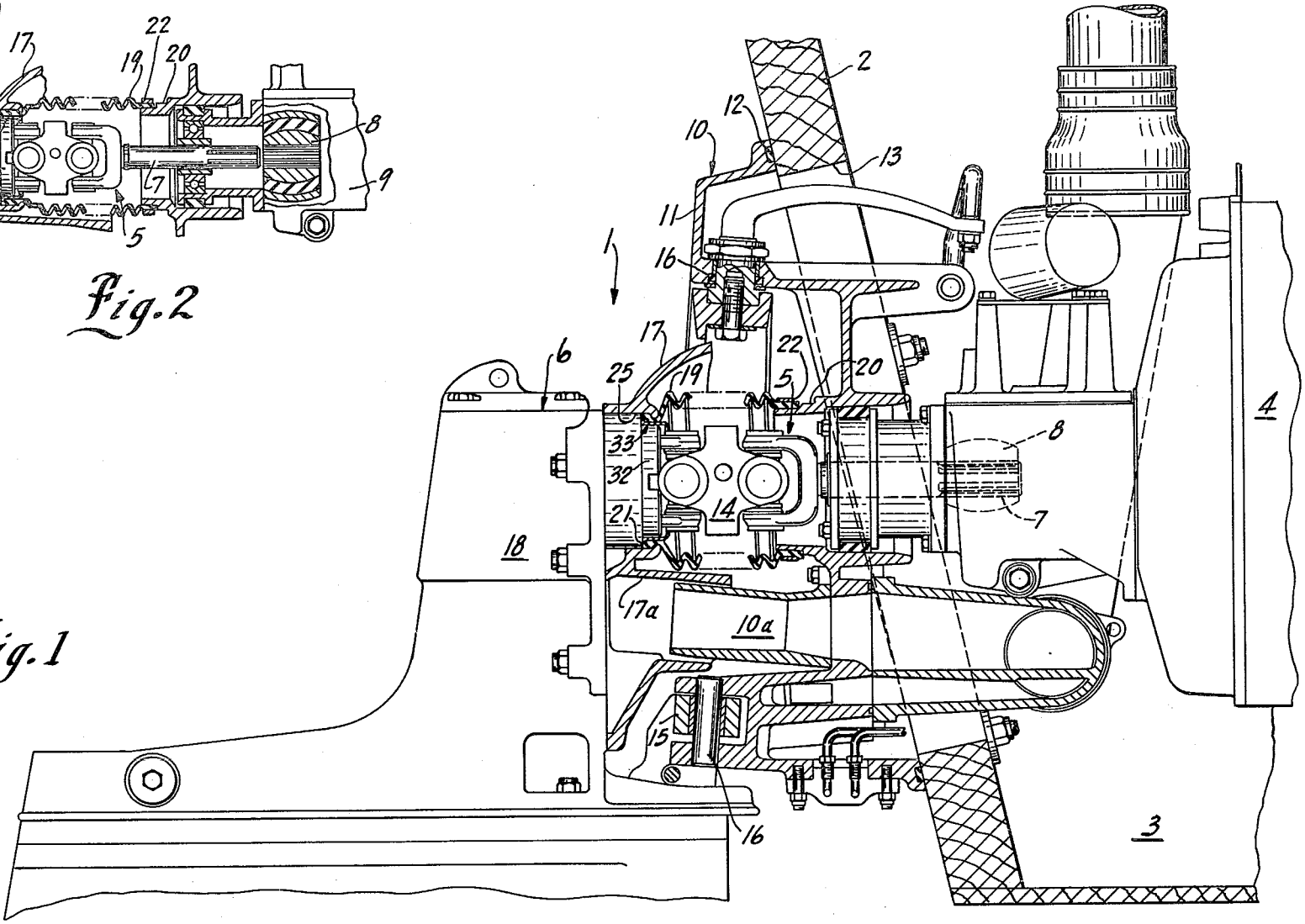
FIG. 1 is a side elevational view partially in section of a stern drive unit attached to the transom of a boat particularly illustrating the connection of the flexible bellows member.

FIG. 1 illustrates a stern drive unit 1 mounted to the transom 2 of a boat 3. An inboard mounted engine 4 is secured within the boat 3 and interconnected through a universal drive coupling 5 to the drive unit 1. The drive unit 1 generally includes a drive unit housing 6 having a splined horizontal drive shaft 7. The drive shaft 7 is connected by the universal drive coupling 5 to the splined drive shaft 8 end of the engine crankshaft 9.

A transom mount 10 secures the drive unit 1 to the transom 2. The transom mount 10 generally includes a transom mounting bracket 11 and a transom seal 12 for sealing the transom opening 13. The transom mount 10 also includes an opening through which the connecting drive extends. The drive unit housing 6 also includes a bell housing 17 pivotally attached by pivot means 14 to gimbal ring 15. The gimbal ring 15 is in turn pivotally attached to the transom bracket 11 at horizontal pivots 14 for trimming and at vertical pivots 16 for steering. The bell housing 17 is bolted to the drive unit housing 6.

An exhaust tube 17*a* projects forwardly beneath the drive coupling 5 and engages with an exhaust tube 10*a* extending rearwardly from transom mount 10.

A flexible bellows 19 encircles the drive coupling 5 and is secured at the inner end to a tubular portion 20 extending within the transom mounting bracket 11 and at the outer end is uniquely sealably secured in accordance with the teaching of the present invention as at connection means 21. The inner end of the bellows 19 is secured with the bellows 19 telescoped over the tubular portion 20 and clamped with clamping band 22. The flexible bellows 19 is formed with a corrugated bellow like wall using a suitable rubber-like material. The flexible bellows 19 permits the drive unit 1 to freely pivot about both the vertical and horizontal pivot axis while maintaining the desired seal. The present invention eliminates the need to obtain access within the bell housing 17 to assembly or release the clamping band. This is particularly significant where the shape and the location of the exhaust tube 17*a* makes working access within the bell housing extremely difficult.

Figure 2:
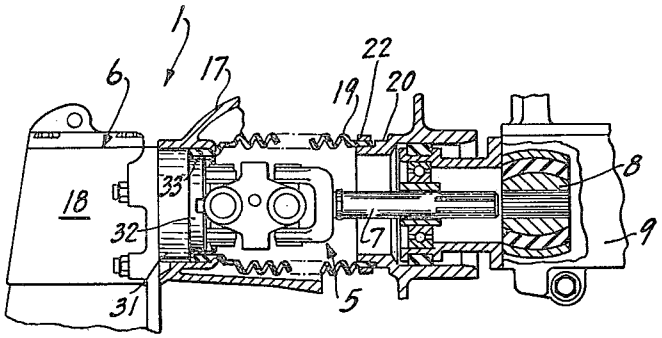
FIG. 2 is a reduced fragmentary view illustrating the attachment of the drive unit end of the flexible bellows illustrated in FIG. 1.
Figure 3:
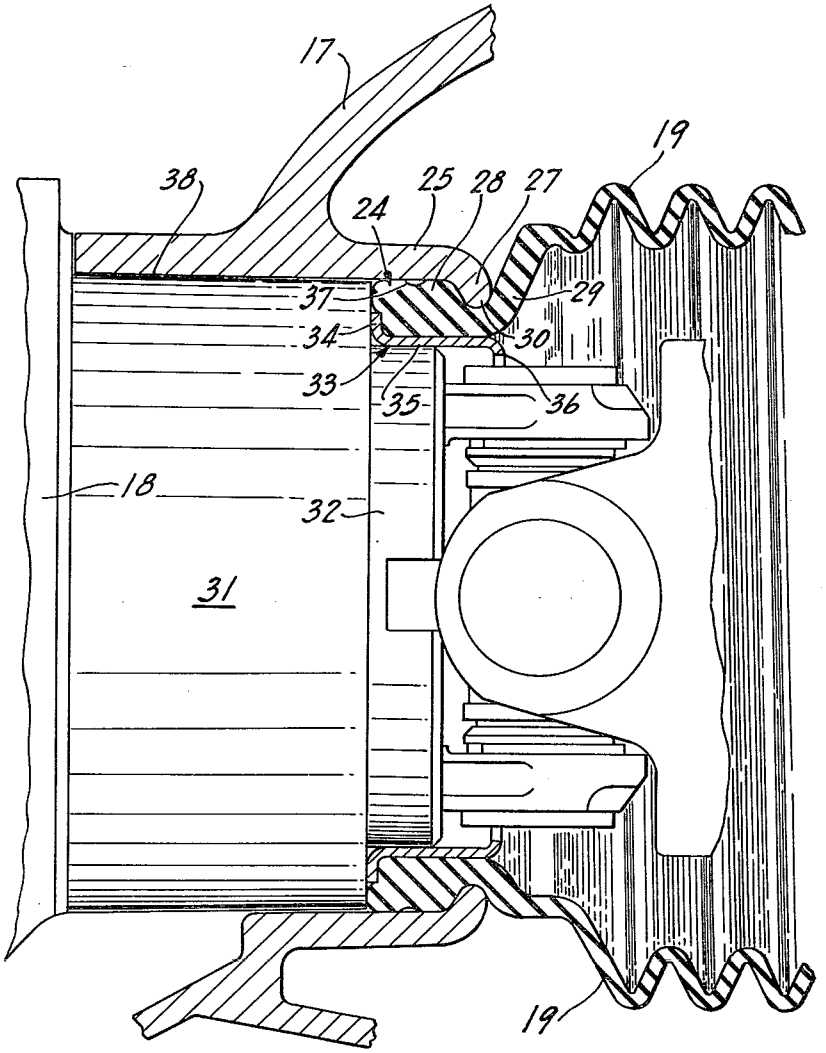
FIG. 3 is an enlarged sectional view similar to that of FIG. 2.

The connection means 21 shown in FIGS. 1 through 3 include a rectangular shaped bead 28 on the end of bellows 19 which is located within a recess or clamping chamber 24 defined by complimentary surfaces on the bell housing 17 and the drive unit housing 6. The bead 28 has a generally rectangular cross-section and is integrally formed at the periphery of one end of the bellows 19. The bead 28 includes an inclined connecting wall 29 defining an annular groove 30 which mates with the lip 27. As shown in FIGS. 1 through 3, when the drive unit 1 is properly installed the bead 28 provides a fluid tight connection.

As more clearly shown in FIGS. 2 and 3, the bell housing 17 is formed with a cylindrical opening having a wall 25. The wall 25 terminates at an inner lip 27 which defines an end surface for the clamping chamber 24.

The drive unit housing 6 includes a projecting member 31. The projecting member 31 has an outer diameter only slightly less than the inner diameter of opening. The projecting member 31 is also somewhat shorter than the length of the wall 25 and includes an inner clamping nut 32 having a diameter somewhat smaller than that of the projecting member 31. The inner clamping nut 32 also is smaller than that of the bead 28.

Referring to FIG. 3 a stepped ring or retaining sleeve 33 is inserted over the clamping nut 32. The retaining sleeve 33 includes an inner projecting radial wall 34 integrally formed to overlap the outer end of a cylindrical portion 35 and an outer radial wall 36 to extend upward at the inner end of portion 35. The cylindrical portion 35 telescopes over nut 32 with the outer radial wall 36 abutting the end of the bead 28. The retaining sleeve 33 is forced into abutting engagement with the outer end face of the bead 28 and in combination with the inner lip 27 of the wall 25 defines the clamping chamber 24.

The bead 28 is formed somewhat greater in width and depth than that of the clamping chamber 24. The outer surface or wall of bead 28 may be formed with a slight circular depression or groove 37 to define a pair of deflectable lips. The deflectable lips permit compression of the bead 28 within the clamping chamber 24.

In the assembly of the flexible bellows 19, the inner end is first clamped to the inner mounting member 20 with clamping band 22. The outer bellows end is then assembled by inserting the bead 28 between the wall 25 and the retaining sleeve 33. Since the retaining sleeve 33 traps the bead 28, this retains the bellows 19 in the desired position in the bell housing 17 and permits easy installation of the drive unit 1. The drive unit housing 6 is then inserted into the bell housing 17. As the drive unit housing is inserted, the projecting member 31 compresses the bead 28 between the retaining sleeve 33 and the wall 25. The outer radial lip 34 of the retaining sleeve 33 is forced against the end portion of the bead 28 as shown in FIG. 3 and the end wall of the pilot projection 31 is forced against the outer end of the bead 28. This forms a liquid tight joint which completely seals the passageway 38 between the wall 25 and the projecting member 31.

Figure 4:
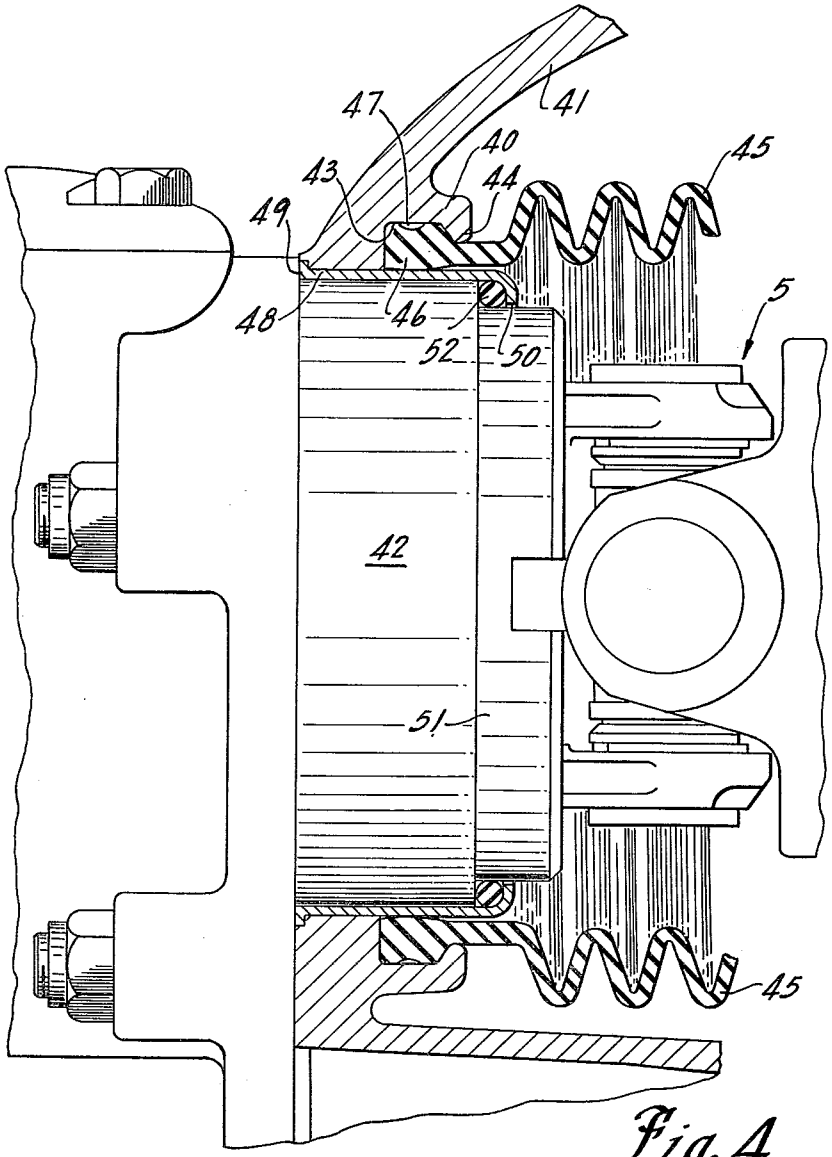
FIG. 4 is a view similar to FIG. 3 illustrating an alternative construction.

An alternate embodiment is shown in FIG. 4. An opening having a wall 40 is again integrally formed within a bell housing 41. The wall 40 in this embodiment is relatively short and is particularly designed for a drive unit having a short cylindrical projecting member 42. An annular recess or clamping chamber 43 having a generally rectangular cross-section is formed within the clamping wall 40 to accept a bead 46. The outer side wall 44 of the recess 43 is of a larger internal diameter than the inner side wall to accommodate the tubular body of the flexible bellows 45. The bead 46 is formed at the end of the flexible bellows 45 as an outwardly projecting enlargement having a rectangular cross-section generally corresponding to but slightly deeper than recess 43. The outer surface of the bead 46 is also formed with a circular depression or groove 47 to engage the inner side wall 44. A retaining sleeve 48 is secured within the wall 40 with a short outer radial lip 49 in abutting engagement with a recess in the outer end surface of the end wall of the bell housing 41. The sleeve 48 has an inner diameter corresponding to the outer diameter of the pilot projecting member 42 and is in compressing engagement with the interior surface of the bead 46 to forcibly maintain the bead 46 within the recess 43. The sleeve 48 has an inner radial lip 50 which overhangs the projecting member 42 as shown in FIG. 4. An O-ring seal 52 is compressed between the inside end of the lip 50 and the outside end of the projecting member 42 and between the clamping nut 51 and the sleeve 48.

In assembling the bellows 45 the bead 46 is first positioned in the recess 43. The O-ring seal 52 is then positioned over the retaining nut 51 and the retaining sleeve 48 is positioned over the projecting member 42. The projecting member 42 with clamping sleeve 48 in place is then inserted into the bell housing 41. The drive unit housing is then bolted to the bell housing to clamp the bead 46 within the recess 43.

The first embodiment of the invention shown in FIGS. 1 through 3 eliminates the necessity of the machining of a separate recess or clamping chamber in the wall portion of the opening in the bell housing as required in the second embodiment. Either embodiment provides a satisfactory method of sealably connecting the flexible bellows to the drive unit without the need for internal access to the outer end of the bellows and without the need for any special tooling.

With the present invention the outer connection of a flexible bellows is directly made by the assembly of the drive unit to the bell housing. To release the drive unit for maintenance or replacement it is only necessary to remove the drive unit housing from the bell housing. This completely removes the drive unit housing while leaving the outer end of the flexible bellows in place. After the drive unit is removed the inner end can be conveniently and easily removed.

I claim:

1. A marine stern drive comprising (a) a transom mount having a drive coupling opening therethrough, (b) a bell housing having a drive couping opening therethrough, (c) pivotal attachment means between said transom mount and said bell housing, (d) a drive unit housing having a projecting mounting member, (e) a drive coupling extending through said openings in said transom mount and said bell housing, (f) complementary surfaces on said drive unit housing and said bell housing at said drive coupling opening of said bell housing defining an annular chamber therebetween, (g) a flexible bellows extending over said drive coupling and having a bead shaped end clamped within said annular chamber, (h) a retaining member engaging at least the inner surface of said bead shaped end, and (i) wherein said complementary surface on said drive unit housing includes an outwardly extending radial wall to form a full end wall of said annular recess and said bell housing includes an inwardly extending radial wall to form a partial end wall of said annular recess.

2. The marine stern drive defined in claim 1 wherein said bead shaped end projects outwardly from the external wall of said flexible bellows with a cross-section complementary but larger than said annular recess.

3. The marine stern drive defined in claim 2 wherein said bead shaped end includes a circular depression on the outer peripheral wall surface thereof, said depression forming two parallel lip portions which deflect within said annular recess.

* * * * *